United States Patent [19]

Niethammer et al.

[11] Patent Number: 4,493,116

[45] Date of Patent: Jan. 15, 1985

[54] METHOD FOR MANUFACTURING SLEEVED GARMENTS

[75] Inventors: Heinz K. Niethammer, Roswell; Lawrence J. Montgomery, Atlanta, both of Ga.

[73] Assignee: Kimberly-Clark Corporation, Neenah, Wis.

[21] Appl. No.: 415,660

[22] Filed: Sep. 7, 1982

[51] Int. Cl.[3] ..... A41D 13/00

[52] U.S. Cl. ..... 2/69; 2/114; 2/115; 2/243 B

[58] Field of Search ..... 2/114, DIG. 7, 243 R, 2/243 B, 79, 227, 115, 49 R, 406, 403, 69, 83

[56] References Cited

U.S. PATENT DOCUMENTS

| | | | |
|---|---|---|---|
| Re. 30,520 | 2/1981 | Pierron | 2/243 R X |
| 2,993,528 | 7/1961 | Plant, Jr. | 154/42 |
| 3,129,432 | 4/1964 | Belkin | 2/114 |
| 3,139,365 | 6/1964 | Andrews | 156/179 |
| 3,146,465 | 9/1964 | Hummel | 2/49 R |
| 3,221,341 | 12/1965 | Hummel | 2/49 R |
| 3,435,461 | 4/1969 | Artzt | 2/83 |
| 3,681,785 | 8/1972 | Truman | 2/243 R |
| 3,696,445 | 10/1972 | Craig | 2/243 R |
| 4,316,756 | 2/1982 | Wilson | 2/243 B X |

*Primary Examiner*—H. Hampton Hunter

*Attorney, Agent, or Firm*—William D. Herrick; R. Jonathan Peters; Howard Olevsky

[57] ABSTRACT

A method is disclosed for manufacturing garments from continuous webs in which flattened pairs of left and right sleeves arranged in series are made from longitudinally moving superposed webs of sleeve material and transferred to parallel shingled arrangement in which elastic is attached to the cuffs. Sleeves with cuff elastic are transferred to a first moving web of garment body material and attached to the web; the first web and attached sleeves are combined with and attached to a second moving web of garment body material which is severed along transverse shoulder seam lines to form garments.

25 Claims, 22 Drawing Figures

FIG. 7
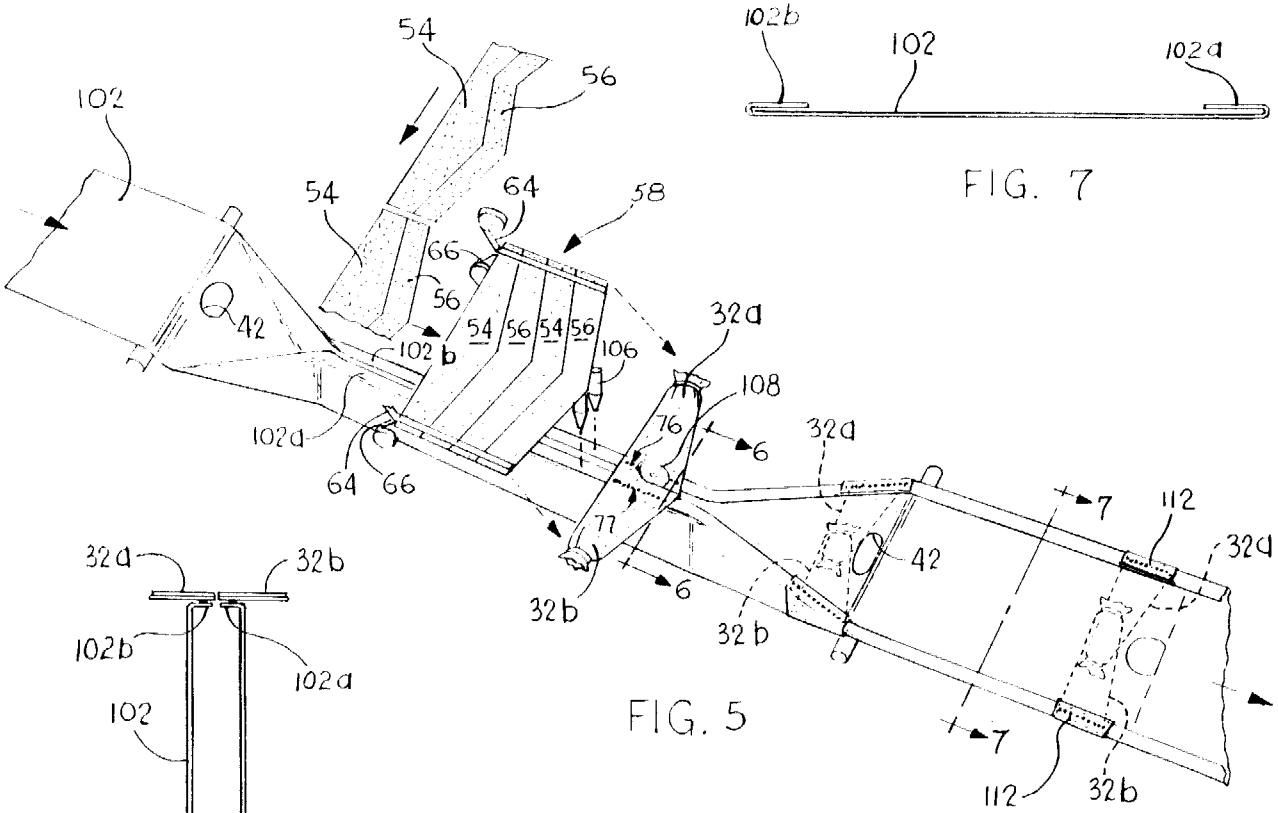
FIG. 5
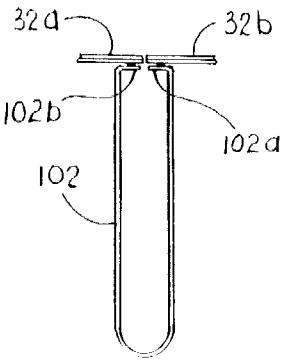
FIG. 6

METHOD FOR MANUFACTURING SLEEVED GARMENTS

TECHNICAL FIELD

This invention relates to the manufacture of garments and, more particularly, to the manufacture of garments in series from continuous moving webs which form both the sleeves and the body panels of the garments.

BACKGROUND ART

Heretofore it has been proposed to manufacture garments in series from webs and pre-manufactured sleeves on automated production lines, a method and apparatus for such manufacture being illustrated in commonly assigned U.S. Pat. No. 3,681,785. Using this method and apparatus, or the method and apparatus of other prior patents, such as Pierron, U.S. Pat. No. Re. 30,520, and Craig, U.S. Pat. No. 3,696,445, pre-manufactured, individual sleeves are supplied to the production line and united with continuous moving webs from which the body panels of the garment are fashioned. The individual sleeves may be placed on the continuous moving webs so that they extend transversely with respect to or are aligned with the direction of movement of the webs, depending on the type of garment being made and the details of the method used. Sleeves are shown placed so that they extend transversely to the direction of movement of the webs, and an automated sleeve placement apparatus is provided for that purpose in prior U.S. Pat. No. 3,681,785. Sleeves are shown placed in line with the direction of movement of the webs and an apparatus is provided for feeding sleeves in this manner in Craig, U.S. Pat. No. 3,696,445. Pierron, U.S. Pat. No. Re. 30,520, also discloses a method in which sleeves are placed in line with the direction of movement of the webs; such methods produce raglan sleeve style garments.

Also known are methods for making garments with sleeves from continuous webs by cutting such webs into portions of garments constituting both the body panels and the garment sleeves and assembling the garment portions by hand to form complete garments. Artzt U.S. Pat. No. 3,435,461 discloses such a method for manufacturing an infant's garment.

In addition to what is shown in such patents, methods are known and have been practiced commercially for making garments from continuous webs. Such commercial practice has involved sleeve making from continuous webs as a separate operation from the assembly of such sleeves with continuous webs to make the finished garments.

It has not been known, as far as we are aware, to incorporate sleeve making in a unified method involving sleeve making from continuous webs and transferring and combining such sleeves with continuous moving webs adapted to form the body panels of the garments, providing an overall continuous method for manufacturing garments entirely from moving webs in series and continuously in a fully automated manner.

Furthermore, while garments have been manufactured commercially with elasticized cuffs on the sleeves and the sleeves have been made in series from continuously moving webs, the attachment of the cuff elastic has involved a separate manual sewing operation on individual sleeves which has interrupted the continuous nature of the overall method.

With the objective of automating a garment making method, the sleeve transfer apparatus of U.S. Pat. No. 3,681,785 was developed for transferring sleeves from a stack and placing such sleeves on a moving web. When, however, elastic is applied to the cuffs, the cuffs are gathered by the elastic and changed from a flattened condition to a tubular condition of greater thickness. The placing of a number of sleeves with elasticized cuffs on top of one another results in an uneven stack due to the greater thickness of the cuffs, compared with the flattened condition of the armhole ends of the sleeves. Such an uneven stack raised problems with the operation in practice of the sleeve transfer apparatus shown in said U.S. Pat. No. 3,681,785.

Accordingly, it has not heretofore been found feasible to provide a continuous method which is capable of being fully automated for the manufacture of garments from moving webs including attaching elastic to the cuffs of the sleeves.

DISCLOSURE OF THE INVENTION

The principal object of this invention is to provide a continuous method capable of being fully automated for manufacturing garments from moving webs which includes attaching elastic to the cuffs of the sleeves in one stage of the method.

Another object of this invention is to provide a manufacturing method for the production of sleeves with elasticized cuffs which is capable of being fully automated and which may be used for the production of sleeves for subsequent assembly with other garment components to make finished garments.

A more detailed object is to provide a method for manufacturing garment sleeves with elasticized cuffs in which sleeves manufactured in continuous series are severed in pairs associated cuff to cuff or shoulder to shoulder and are then transferred as pairs from series to parallel shingled arrangement with cuffs in alignment for application of elastic.

Another object is to simplify the mechanical execution of such a method by producing the sleeves in multiple continuous series of pairs, thereby permitting a decrease in the transfer rate of sleeves to the shingled arrangement.

A further object is to provide such a method which allows great flexibility in the arrangement and orientation of the different stages of the method and, particularly, permits orientation of the continuous series line for the production of sleeves to be at any desired angle relative to the axis of the shingled arrangement to which the sleeves are transferred for application of elastic.

An important object of the invention is to provide a continuous method for manufacturing garments with attached sleeves from moving webs, including manufacturing the sleeves in series, transferring and combining the sleeves with moving webs adapted to form the body panels of the garments and integrating the sleeve making, transferring and combining in a continuous overall method capable of being fully automated.

Another important object is to provide a continuous method for manufacturing garments from moving webs, the garments being of the type having sleeves attached to the body panels of the garments.

Another object of the invention is to provide a continuous method for manufacturing garments which is not limited to garments of a single configuration or solely to garments with sleeves and can be varied to permit the manufacture of garments of different configurations.

Another object of the invention is to provide a continuous method for manufacturing garments which is not limited to garments of a single size and can be varied to permit the manufacture of garments of different sizes.

Another object of the invention is to provide a continuous method for manufacturing garments which is not limited to garments of a single seam construction and can be varied to permit garment assembly by a variety of different seam forming methods including adhesive attachment, ultrasonic bonding and sewing.

Another object is to provide a garment of the type having sleeves attached to body panels by seams at the arm holes at the shoulders which is capable of being manufactured in a continuous method from continuous webs.

BRIEF DESCRIPTION OF THE DRAWINGS

Further objects and advantages of the invention will become clear from the following description taken in conjunction with the accompanying drawings, in which:

FIG. 4A is a fragmentary transverse sectional view taken in the plane of lines 4A—4A in FIG. 1;

FIG. 5 is a schematic view of sleeve transfer sections of an alternative embodiment of a garment manufacturing method utilizing this invention;

FIGS. 6 and 7 are transverse sectional views taken in the planes of lines 6—6 and 7—7 respectively of FIG. 5;

BEST MODES FOR CARRYING OUT THE INVENTION

Figure 1:
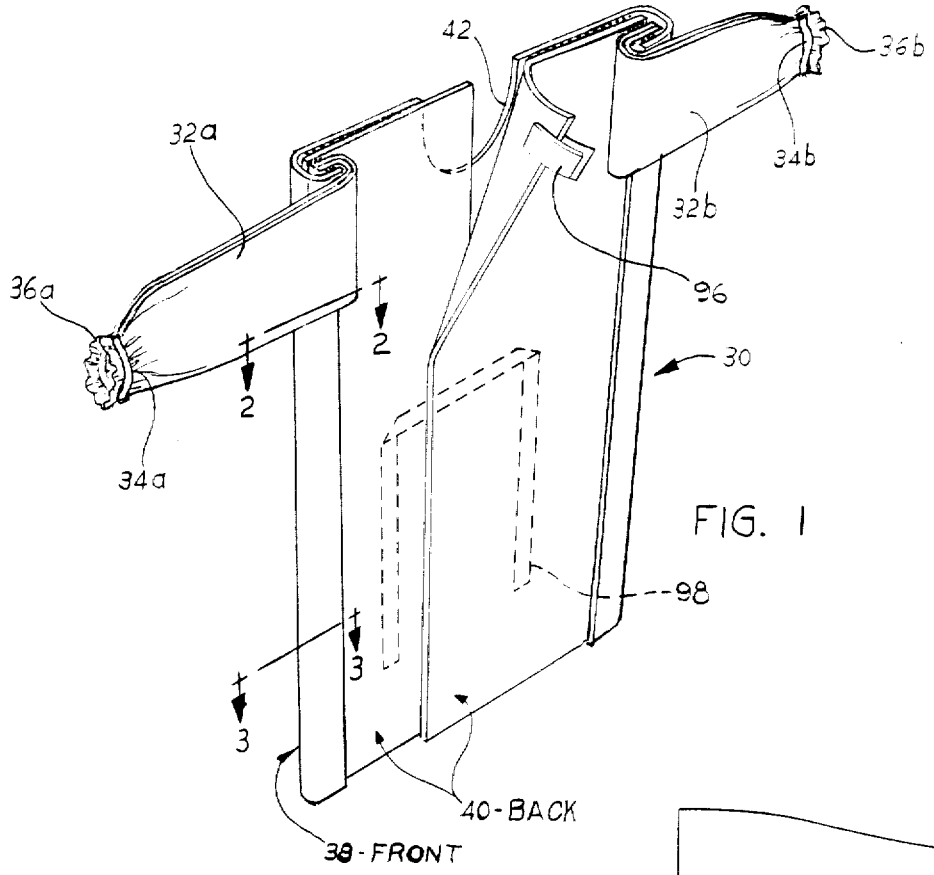
FIG. 1 is a perspective view of one type of garment adapted to be made with the method of this invention.

Turning to FIG. 1, there is shown a garment 30 of the kind adapted to be manufactured using the method of this invention. Garment 30 has sleeves **32*a*, 32*b* with cuff elastic 34*a*, 34*b* providing gathered cuffs 36*a*, 36*b*. For purposes of illustration, the garment 30** is of the type commercially sold as a disposable hospital gown. Such garments have been produced on garment production lines from pre-manufactured sleeves having elasticized cuffs and continuous, moving webs of garment material adapted to form the body panels of the finished garments, generally as shown in U.S. Pat. No. 3,681,785. Various kinds of garment material may be used for both the body panels of the garments and the sleeves, depending on the end use of the garments. For hospital gowns, particularly useful materials are disclosed in U.S. Pat. No. 3,855,046, as nonwoven, pattern bonded polymeric webs. For convenience, the term hospital gown has been used in a broad sense to include cover gowns, isolation gowns and other gowns used in a hospital environment.

The sleeves **32*a*, 32*b* and front and back panels 38, 40 of the garment 30 are attached along seams preferably formed by adhesive, although other seam forming methods may be used including such seam forming methods as ultrasonic bonding and sewing. The particular garment shown in FIG. 1 has a full width front panel 38 and a divided back panel 40 with a neck opening 42 in the front panel 38. It will be understood that such a garment is suited particularly for use as a hospital gown with its divided back panel, but by varying the location of the neck opening 42** and the shape of the components, garments of other kinds and shapes can be made to suit other end uses.

METHOD OF FIGS. 4, 4A

Figure 4:
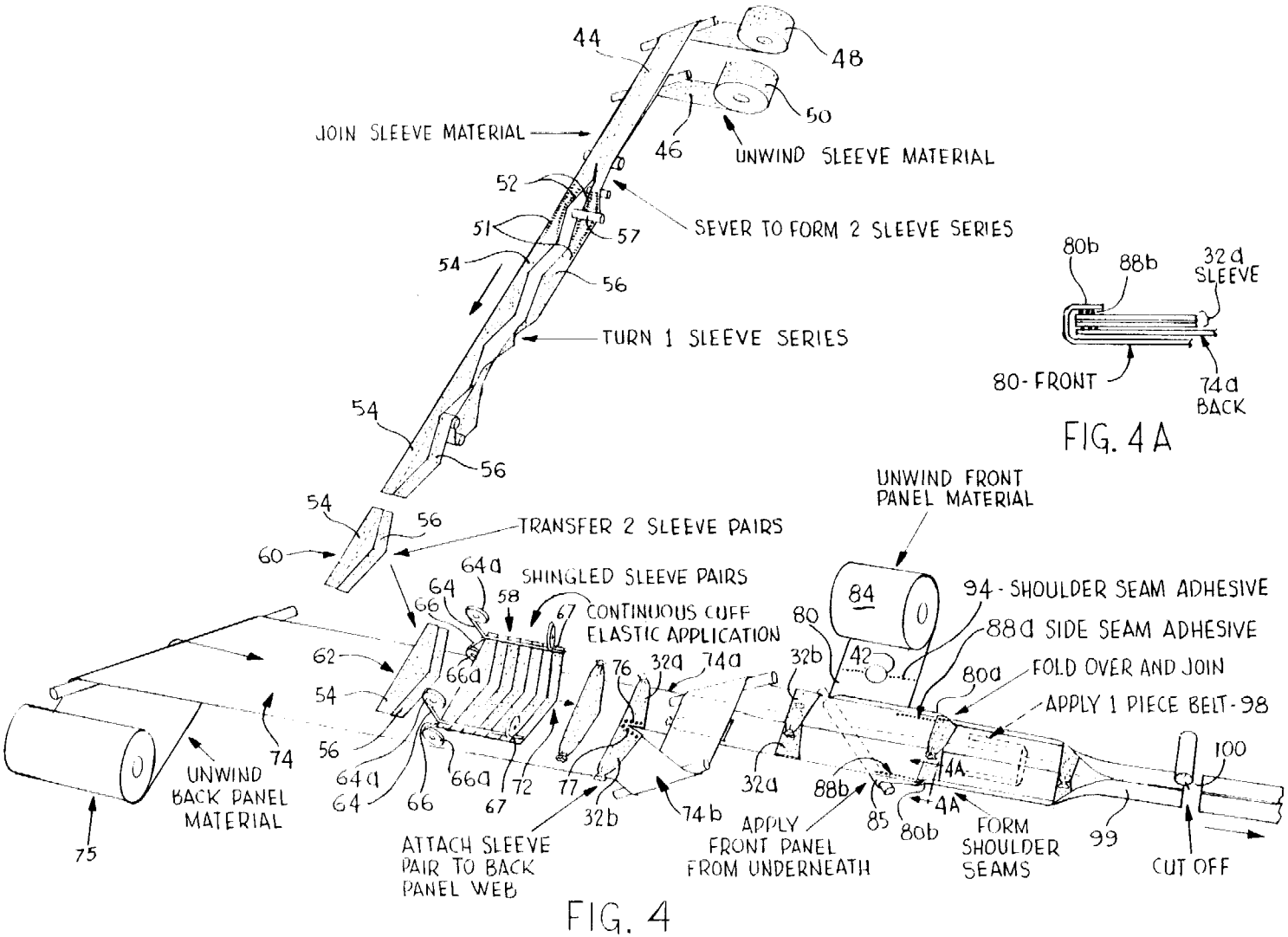
FIG. 4 is a schematic view of a preferred embodiment of a garment manufacturing method utilizing this invention.

Referring now to FIG. 4, a preferred method embodying the invention is illustrated for manufacturing garments from continuous webs. While this method is particularly useful for the manufacture of garments of the type shown in FIG. 1 and known as hospital gowns, the method of this invention can be used for the manufacture of a wide variety of garments of different size, shape and type.

Figure 1A:
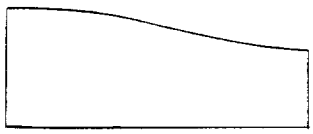
FIG. 1A is a plan view of an alternative sleeve pattern for the garment of FIG. 1.
Figure 2:
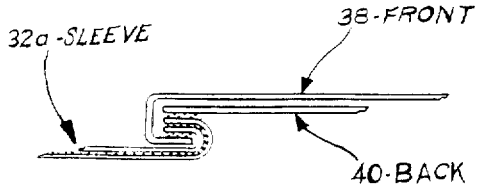
FIGS. 2 and 3 are transverse sectional views illustrating the seam construction of the garment of FIG. 1 taken respectively substantially in the plane of lines 2—2 and 3—3 of FIG. 1.

In the method illustrated in FIG. 4, continuous moving webs 44, 46 of sleeve material are unwound from rolls 48, 50 and guided into superposed relation. The webs 44, 46 are joined along glue lines 51 adjacent the margins and severed along longitudinal seam lines 52 defining continuous series-arranged pairs 54, 56 of left and right sleeves. While various seam forming methods can be used where the sleeve materials are nonwoven webs of the type described in U.S. Pat. No. 3,855,046, it is presently preferred to use hot-melt adhesive to join the webs and form the seams by applying the adhesive to the surface of one of the webs 44, 46 before they are brought together. The severing operation is schematically shown in FIG. 4 and is carried out to longitudinally sever the superposed webs 44, 46 along straight line segments which, as shown in FIG. 4, will define tapered sleeves 32*a*, 32*b* joined shoulder to shoulder and cuff to cuff. The sleeve shape may be varied, for example, by sinusoidally varying the longitudinal seams and cuts to provide a shaped sleeve as shown in FIG. 1A instead of a tapered sleeve as shown in FIG. 1. Alternatively, tubular sleeves can be made instead of tapered or shaped sleeves.

Following the steps of joining and longitudinally severing the superposed webs 44, 46, according to this invention, to orient the sleeve pairs for subsequent processing, one of the continuous series-arranged sleeve pairs 56 is turned and phased by means such as guide rollers 57 relative to the sleeve pairs 54 of the other series to bring the sleeve pairs of both series into the same phase with the cuffs sequentially in line. Sets of two sleeve pairs 54, 56 are then severed by transverse cuts where the cuffs are joined. The severing operation is carried out to provide sets 60, 62 of two sleeve pairs 54, 56, each associated shoulder to shoulder and having free cuff ends.

In accordance with this invention, in order to attach elastic to the cuffs of the garment sleeves without interruption of the continuous nature of the method, the sleeve pairs 54, 56 are transferred from series arrangement to parallel shingled arrangement 58 in which elastic can be attached to the cuffs while sequentially aligned and in a continuous manner. FIG. 4 illustrates a set 60 of two sleeve pairs 54, 56 as well as the preceding set 62 of two sleeve pairs 54, 56 in the process of being transferred to the parallel shingled arrangement 58 after being severed from the webs 44, 46. The sleeve pairs 54, 56, after severing from the webs 44, 46, are transferred to a position between converging elastic bands 64, 66 being unwound from supply rolls 64*a*, 66*a* on each side of the shingled arrangement 58. The elastic bands 64, 66 are maintained under tension while being unwound from the supply rolls 64*a*, 66*a* and are attached to the cuffs by adhesive or other attachment means. With the arrangement shown, elastic bands 64 are attached on the top surface of the cuffs and separate elastic bands 66 are attached to the bottom surface of the cuffs at both ends of each pair of sleeves 54, 56. In this manner, in effect, a loop of elastic is provided around each cuff. The application of elastic bands 64 to solely the top surface of the cuffs (or bands 66 solely to the bottom surface) is an alternative to provide a partially gathered cuff that is suitable for some end uses.

With the preferred arrangement as shown, the elastic bands 64, 66 on both top and bottom surfaces are severed (for example, along severance lines 67) where they extend between cuffs of the adjacent forwardmost sleeve pairs 54, 56 in order to separate each successive sleeve pair with cuff elastic from the remainder of the shingled arrangement 58. If desired, when placing the sleeve pairs 54, 56 in the shingled arrangement 58, the cuffs of adjacent sleeve pairs 54, 56 may be spaced slightly to leave clearance for a cutting element to avoid cutting the sleeve material along the severance line 67 while allowing the elastic bands to be severed.

As shown in FIG. 4, the sleeve pairs 54, 56 enter the shingled arrangement 58 between the converging elastic bands 64, 66 and are carried to the forward end 72 of the shingled arrangement from which they are severed for transfer and combining with garment webs adapted to form the body panels of the garments. Thus, left and right sleeves of successive pairs 54, 56 are transferred continuously from series arrangement to parallel longitudinally spaced positions on a first moving web 74 of garment material and the shoulder ends of the sleeves are attached to the moving web 74.

In keeping with the invention, the method entails transferring sleeves having cuff elastic after being severed from the shingled arrangement 58 and placing the sleeves at longitudinally spaced positions, as shown in FIG. 4, on a first moving web 74 of garment body material unwound from a supply roll 75. The garment body material may be a different textile-like material than used for the sleeves; it is preferred, however, to use the same material to facilitate the combining and attaching of the garment components.

In this embodiment of the invention, the flattened sleeve pairs 54, 56 are attached at the shoulder ends to the moving web 74 before being divided into individual sleeves 32*a*, 32*b*. For the purpose of attaching the sleeves to the moving web 74, spaced parallel seams 76, 77 are formed straddling the center line of the moving web by adhesive or other means.

In the present case, the first moving web 74 to which the sleeves are attached is adapted to provide the complementary halves of the back panel 40 of the finished garment. To this end, the first moving web 74 is divided along its center line after attachement of the sleeves to provide two half-width webs 74*a*, 74*b*. Simultaneously with the longitudinal dividing of the first moving web 74, the sleeve pairs 54, 56 are divided into individual sleeves 32*a*, 32*b* by a cutting element severing the sleeve material and the web 74.

In order to bring the sleeves and half-width sections 74*a*, 74*b* of the web 74 into position for combining with a front panel web 80, the half-width sections 74*a*, 74*b* of the moving web 74 are guided and phased into parallel overlapping relationship, as shown in FIG. 4, which locates the shoulder ends of the sleeves 32*a* 32*b* in lateral alignment at the outer margins of the overlapped sections 74*a*, 74*b*.

For this purpose, one section 74*a* of the back panel web 74 continues along a straight path while the other section 74*b* is laterally displaced over turning rolls to the opposite side of the one section 74*a* into parallel overlapping relationship, which arranges the sleeves 32*a*, 32*b* in left and right position with the cuff ends extending inwardly over the center overlapping portions of the web sections 74*a*, 74*b*.

The back panel web sections 74*a*, 74*b* and attached sleeves are then, according to this invention, combined and attached to a front panel web 80 of garment material, preferably the same type of material as the back panels and sleeves. The front panel web 80 has neck openings 42 cut in the web 80 and is unwound from a supply roll 84 and continuously fed around a turning roller 85 underneath and into alignment with the two sections 74*a*, 74*b* of the back panel web 74. The front panel web 80 is wider than the overlapped sections 74*a*, 74*b* in order to provide projecting marginal portions 80*a*, 80*b* which can be infolded about panel sections 74*a*, 74*b* by a folding bar or the like and attached, preferably by adhesive, along longitudinal side seam lines 88*a*, 88*b* to the back panel web sections 74*a*, 74*b* and the shoulder ends of the sleeves 32*a*, 32*b*. To provide the longitudinal side seams, it is preferred to apply adhesive in lines 88*a*, 88*b* along the outer margins of the back panel sections 74*a*, 74*b* and on the upper surface of the shoulder ends of the sleeves 32*a*, 32*b*. These adhesive lines 88*a*, 88*b* will serve to attach panel sections 74*a* and 74*b* as well as the sleeves to the front panel web 80. FIG. 4A illustrates the arrangement of material layers immediately after the folding operation and shows that the back panel sections 74*a*, 74*b* are flat and attached to the sleeves 32*a*, 32*b* at the shoulder ends while the front panel web 80 is folded over the top surface of the sleeves and attached at the shoulder ends.

It is also necessary to provide transverse shoulder seams between the back panel sections 74*a*, 74*b* and the front panel web 80. This may be accomplished by any convenient means, such as by applying transverse lines 94 of adhesive to the front panel web 80 before combining with the back web sections 74*a*, 74*b*.

While garments made with the method of this invention can have different types of closures, in the present case the garments are provided with an adhesive tab 96 (FIG. 1) and one piece belts 98. The closure adhesive tabs 96 may be applied to the back panel sections and the one piece belts 98 may be applied to the front panel web 80 either before or after combining.

Following the combining of the front panel web 80 and the back panel web sections 74*a* and 74*b*, the combined and attached webs and sleeves are folded inwardly to provide a narrow folded assembly 99 for packaging. The narrow folded assembly is then severed by transverse cuts 100 adjacent the shoulder seam lines 94 and extending through the neck openings 42 to provide finished garments 30. The finished garments 30 may be fed to other folding and packaging stations to prepare the garments for delivery to an end user.

METHOD OF FIGS. 5-8

An alternative embodiment of a method utilizing this invention for making garments from continuous moving webs is shown in FIGS. 5-8. In this alternative embodiment of the invention, garment sleeves are made in the manner previously described with reference to FIG. 4 in continuous series in sleeve pairs 54, 56 associated shoulder to shoulder and are transferred from series to parallel shingled arrangement 58 for application of elastic bands 64, 66.

In this embodiment of the invention the sleeve pairs 54, 56 are transferred to a first moving web 102 of garment material which is adapted to form the front panel 38 of the finished garments rather than the back panel 40, as illustrated in FIG. 1. Thus, the moving web 102 is provided with spaced neck openings 42.

Since the front panel 38 of the finished garments 30 is undivided in the type of garment shown in FIG. 1, the moving web 102 adapted to form the front panel 38 is guided to bring marginal portions 102*a*, 102*b* of the web 102 together in the same plane by continuously tucking the moving web 102, as shown in FIG. 6. The sleeves 54, 56 are attached by seams 76, 77, attaching shoulder ends of each pair 54, 56 of associated sleeves to the marginal portions 102*a*, 102*b* of the web 80 which can be formed by adhesive from guns 106 or the like. In this illustration of the method, the sleeves 32*a*, 32*b* are attached to the first moving web 102 while maintained with the shoulder ends abutting, in this case joined, and the sleeve pairs 54, 56 are divided into individual sleeve by a cutting element 108 or the like after being attached to the web 102. Following the step of dividing the sleeve pairs 54, 56, the sleeves and the first moving web 102 are prepared for combining with a second moving web 110 (FIG. 8) which, in this case, will form the back panel 40 of the garment 30 by flattening the web 102 while retaining the marginal portions 102*a*, 102*b* of the web 102 folded inwardly, as shown in FIG. 7. Together with the spreading operation, the sleeves 32*a*, 32*b* are folded against the web 102 leaving strips 112 infolded along the marginal portions 102*a*, 102*b* of the moving web.

Figure 8:
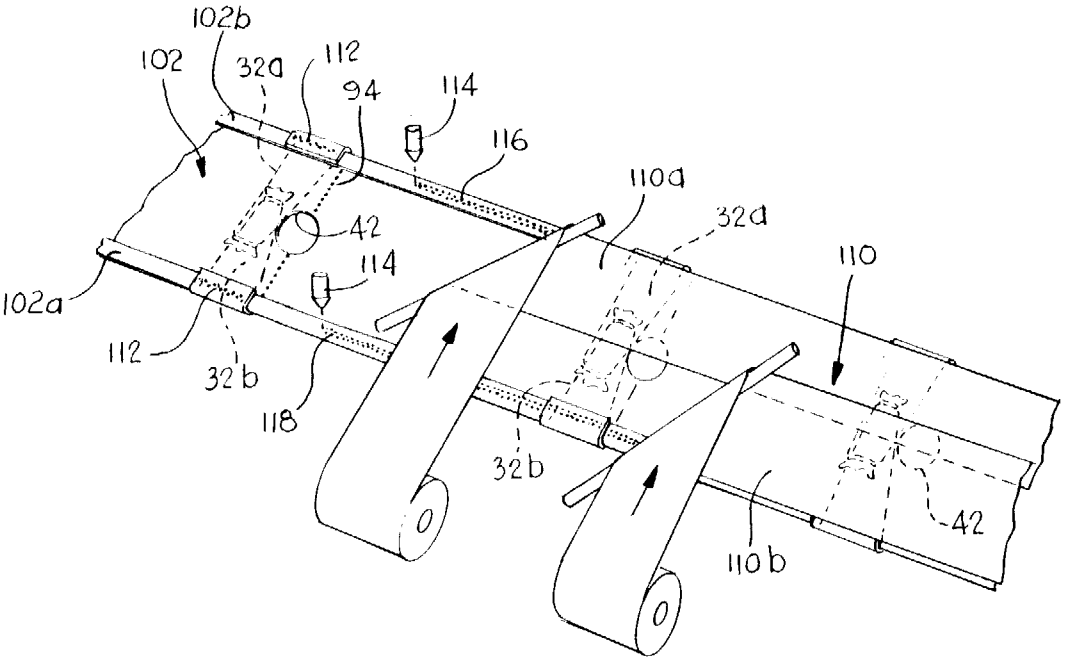
FIG. 8 is a schematic view of a combining section for the alternative method embodiment shown in FIG. 5.

For attaching the first moving web 102 to the back panel web 110, which is illustrated in FIG. 8, continuous lines 116, 118 of adhesive are applied to the marginal portions 102*a*, 102*b* of the first web 102 and also to the infolded strips 112 of the sleeves 32*a*, 32*b* by means such as guns 114. To provide a divided back panel in the garment 30, the web 110 is divided into overlapping sections 110*a*, 110*b* and guided into register with the first moving web 102, the adhesive 116, 118 along the marginal edges being effective to form the side seams for attaching the webs 102, 110 and the sleeves 32*a*, 32*b*. Transverse lines of adhesive 94 are also provided on the front panel web 102 adjacent the neck openings 42 to provide the shoulder seams of the garments. In this case, as in FIG. 4, lapped side seams are formed due to the infolding of narrow marginal portions of one of the garment body webs and attachment to the other along such infolded portions.

After combining the webs and the sleeves, the assembly is carried to folding, cut-off and packaging stations (not shown) of the general type illustrated in FIG. 4 to complete the forming and packaging of the finished garments 30.

METHOD OF FIG. 9

Figure 9:
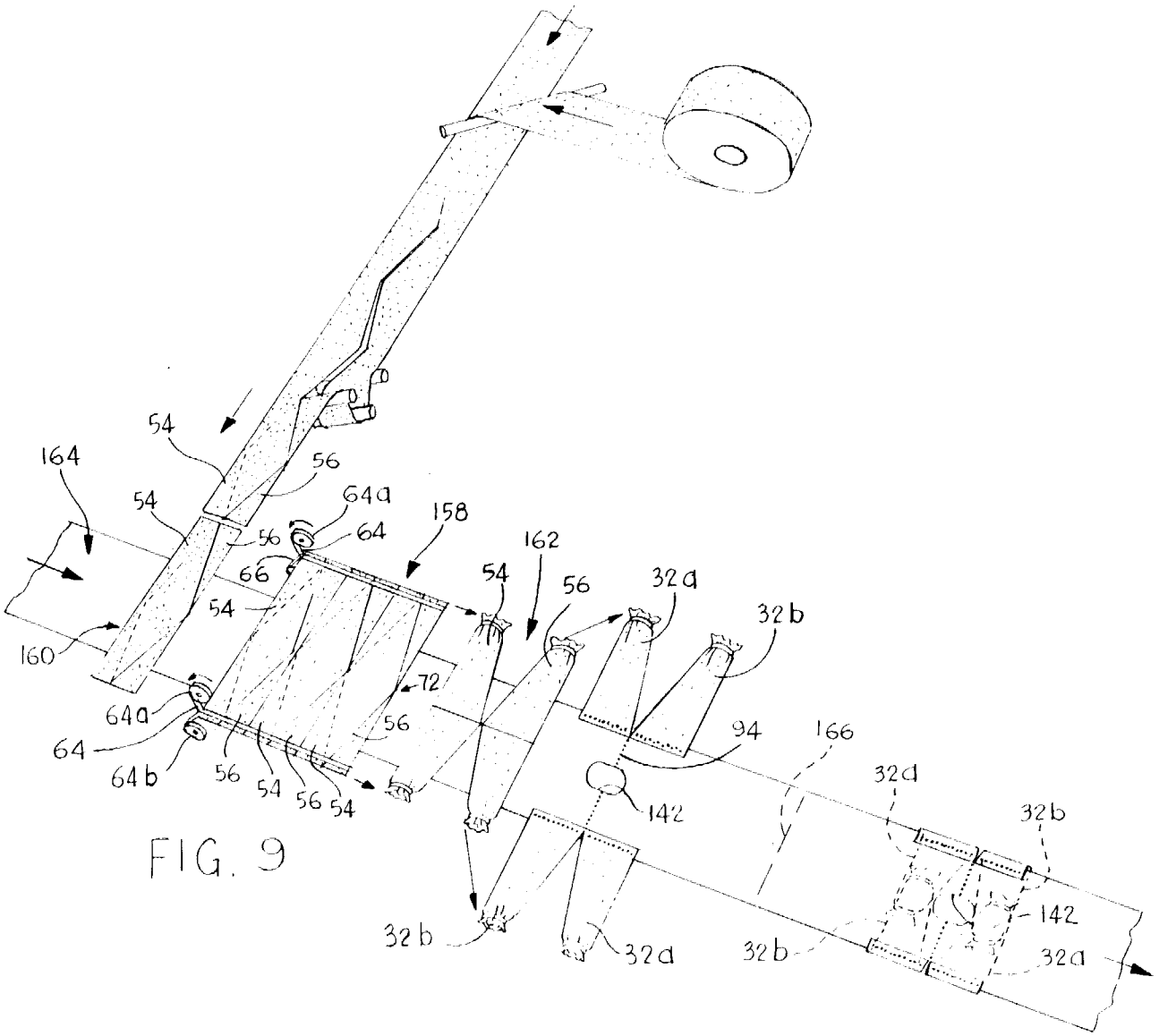
FIG. 9 is a schematic view of sleeve transfer sections of another alternative embodiment of a garment manufacturing method utilizing this invention in which garments are produced head to head before severing into finished garments.

To illustrate variations that may be made in sleeve placement procedures of methods utilizing this invention, reference is made to FIG. 9, which shows a method in which individual sleeves in sets of four are placed on a first moving web of garment material.

To this end, the sleeves for the garments 30 are made in continuous series in pairs 54, 56 but, as contrasted with the methods shown in FIGS. 4 and 5, the sleeve pairs are guided and phased so that the sleeve pairs have the opposite orientation when severed into a set 160 such that cuffs in adjacent pairs are sequentially in line. For this purpose, one sleeve pair 56 is not turned to change its orientation (as in the case of FIG. 4) but only phased relative to the other sleeve pair 54 to obtain the desired opposite orientation with the cuffs in line.

The sleeve pairs 54, 56 are then transferred from series to parallel shingled arrangement 158 with cuffs sequentially in alignment for attachment of elastic. Elastic bands 64, 66 are fed under tension from rolls 64*a*, 64*b* and attached by means such as adhesive, as in the cases to FIGS. 4 and 5, to the cuffs of the sleeves. After being fed to the front end 72 of the shingled arrangement 158, two pairs of sleeves 54, 56 forming a set 160 are transferred to a first moving web 164 adapted to form the front panel of the finished garments 30. To obtain the desired longitudinal positions, the pairs of sleeves 54, 56 which are in overlapping relation in the shingled arrangement 158 are relatively displaced to longitudinally abutting relation in the set 162. The sleeve pairs 54, 56 are divided and the sleeves are then placed and attached as sets of four individual sleeves 32*a*, 32*b* to the moving web 164. The sleeves 32*a*, 32*b* are transferred and placed on the moving web 164 at positions spaced the length of two garments 30 and two sleeves from adjacent pairs 54, 56 are placed on each lateral edge of the web 164. A common elongated neck opening 142 for two garments is provided in the front panel web 164 at the location where the sleeves are placed and a shoulder seam 94 is provided between the garments exceeding transversely to bisect the neck opening 142.

In keeping with the invention, the sleeves are folded under the web 164 to reduce material width and the width of machinery for accommodating such material on the production line. The sleeves and the moving web 164 may then be combined with a divided web adapted to form the back panels 40 of the garments 30 by the procedure generally shown in FIG. 8 including the application of adhesive as by guns 106 to the marginal edges of the moving web 164 to form side seams for attachment of the sleeves and the webs.

It will be seen from FIG. 9 that the marginal edges of the front panel web 164 can be flat when the sleeves are placed and attached to the web 164. When the front panel web is so arranged and brought into registry with a back panel web, the edges of both front and back panels will be exposed on the outside of the garment. If it is desired to provide lapped seams at the sides, the lateral edges of the back panel web are infolded as shown in FIG. 7 before attachment of the sleeves.

Figure 3:
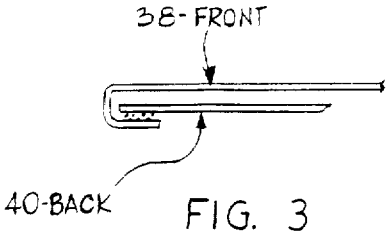

Carrying the concept one step further, to provide side seams with the edges of the fabric of both front and back panels facing inwardly and not exposed in the finished garments, the lateral edges of both the front and back panel webs are infolded before attachment of the sleeves or attachment of the webs to each other. Such infolded lateral edges are shown of a front panel web in FIG. 4 and of a front panel web in FIG. 3.

Following the combining of the front and back panel webs and the sleeves and attachment along side and shoulder seams, the webs are cut off by transverse severing operations including cuts adjacent the shoulder seams 94 and through the neck openings 142. Where the sleeves are placed as depicted in FIG. 9 and the garments are made head to head, the moving webs are severed transversely at locations 166 intermediate the positions of the sleeves in addition to adjacent the shoulder seam lines 94 to separate the finished garments 30.

METHOD OF FIGS. 10 AND 11

Figure 10:
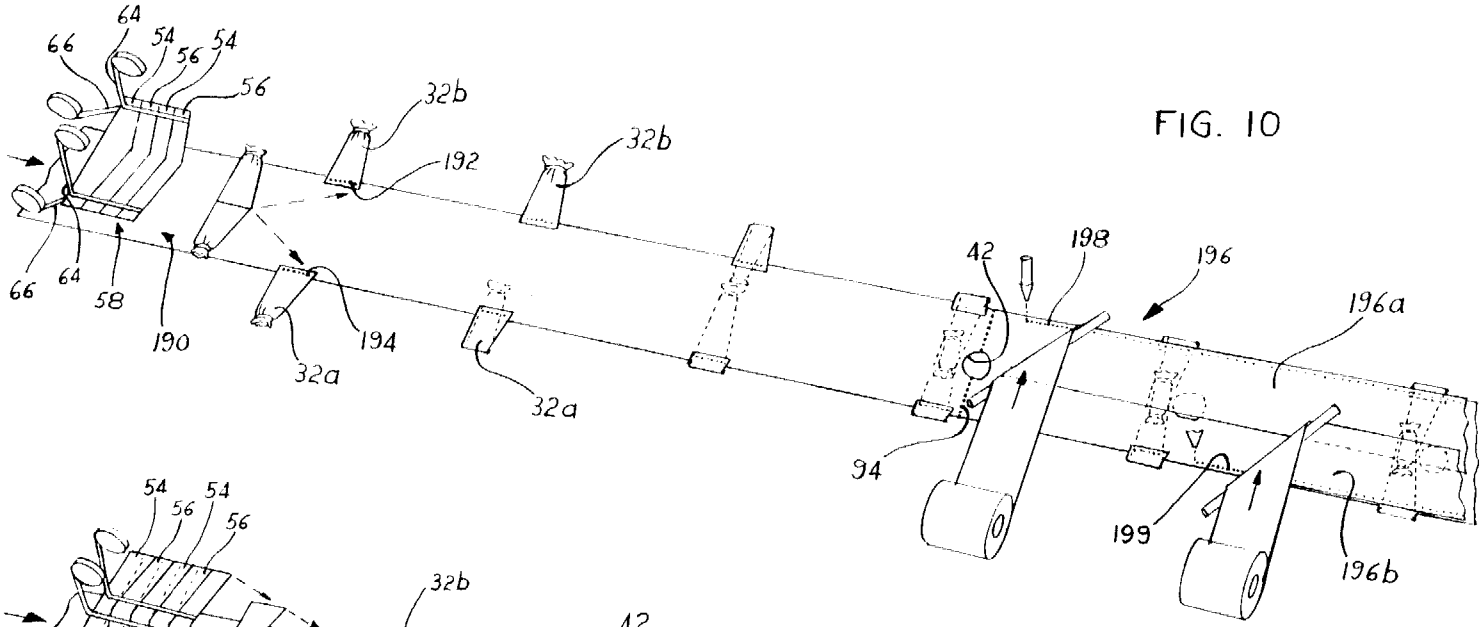
FIGS. 10 and 11 are schematic views of further alternative embodiments of garment manufacturing methods utilizing this invention in which sleeve paris are divided into individual sleeves before transfer and combining with the front panel.
Figure 11:
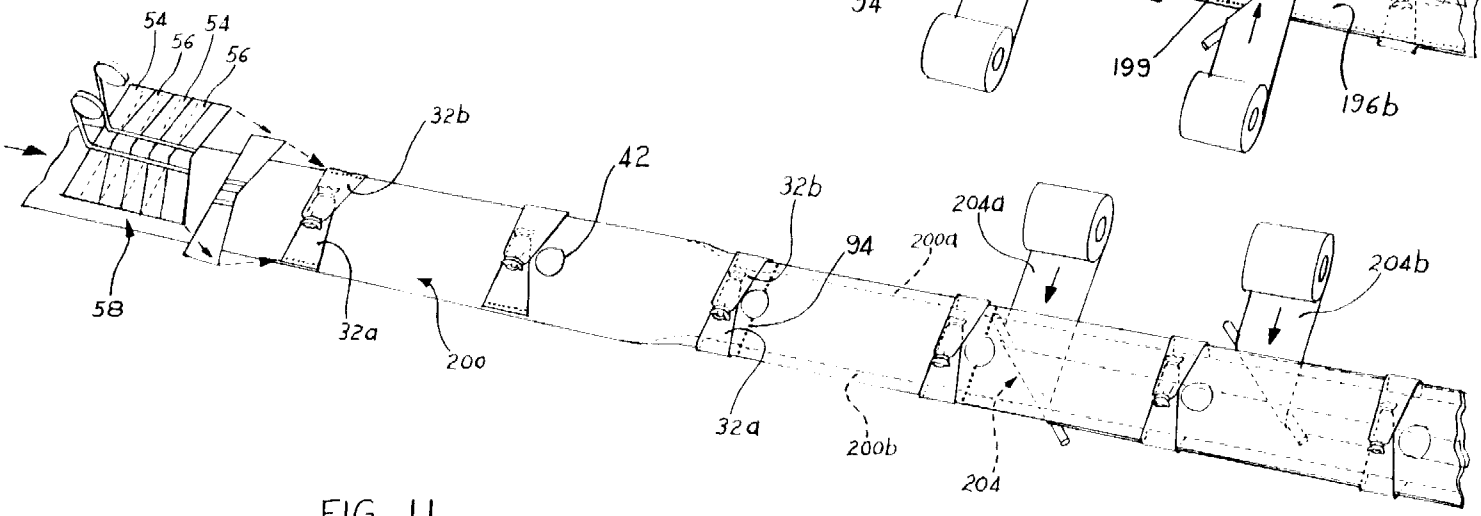

In the embodiments of the invention described in connection with FIGS. 4 and 5, the sleeve pairs are maintained with the shoulder ends of the sleeves abutting as they are placed on the first moving web and the sleeve pairs are divided after such placement. It is contemplated, however, that the sleeve pairs can be divided before placement as shown in FIG. 9. Further examples of the method of this invention in which sleeve pairs are divided before placement are shown in FIGS. 10 and 11. Referring to these Figures, sleeve pairs 54, 56 are provided in a shingled arrangement 58 for attachment of elastic bands 64, 66. In FIG. 10, the sleeve pairs 54, 56 are associated shoulder to shoulder in the shingled arrangement 58, are divided, and are then transferred and placed as individual sleeves 32*a*, 32*b* on the first moving web 190. To demonstrate that the particular way that the sleeves are associated in the sleeve pairs is not critical, in FIG. 11 the sleeve pairs 54, 56 are associated cuff to cuff in the shingled arrangement 58, are divided, and are then transferred and placed as individual sleeves 32*a* 32*b* on the moving web 200.

To attach the sleeves at their shoulder portions to the web 190, as shown in FIG. 10, seams 192, 194 are formed in any desired manner, for example, lines of adhesive can be applied to the moving web 190 or to the sleeves 54, 56 before combining.

Following sleeve attachment, where it is desired to reduce the overall width of the production line, the sleeves 32*a*, 32*b* are folded so that the cuff ends extend inwardly and are flat against the bottom surface of the first moving web 190. To form seams to attach the first moving web 190 (and attached sleeves 32*a*, 32*b*) and a second web 196 provided by partial-width webs 196*a*, 196*b*, adhesive lines 198, 199 can be applied along the lateral edges of the first moving web 190 and transverse shoulder seam lines 94 can be provided adjacent the neck openings 42.

In the embodiment of the invention illustrated in FIG. 10, the second moving web 196 is guided into register with the first web 190 and seams are formed between the flat edges of the webs. In the embodiment illustrated in FIG. 11, the first moving web 200 is folded inwardly along its lateral edges and a second web 204 provided by partial-width webs 204*a*, 204*b* is attached to inwardly folded portions 200*a*, 200*b* of the first moving web to provide lapped side seams. In both embodiments, transverse lines of adhesive 94 adjacent neck openings 42 are provided to form the shoulder seams in the finished garments. Following combining of the webs, the webs and attached sleeves are severed transversely by cuts adjacent the shoulder seams 94 generally in the manner shown in FIG. 4 to produce finished garments 30.

METHOD OF FIGS. 12–15

In order to simplify the transfer of pairs of sleeves to the shingled arrangement, the sleeve pairs can be made in more than two continuous series, which is the arrangement shown in FIGS. 4, 5 and 9. By transferring a greater number of sleeve pairs at one time, preferably an even number to reduce material waste, the cyclic rate of operation of the transfer machinery may be reduced and its overall construction simplified. Thus, referring to FIGS. 12 and 14, sleeve pairs can be made, for example, in four continuous series and transferred after being severed in sets of four pairs to parallel shingled arrangement. To this end, two continuous, relatively wide webs 244, 246 are superposed, eight longitudinally varying seams formed by adhesive or other seam forming methods are utilized to join the superposed webs along longitudinal lines, and the webs 244, 246 are longitudinally severed adjacent the seams to form the illustrated four continuous series.

Figure 12:
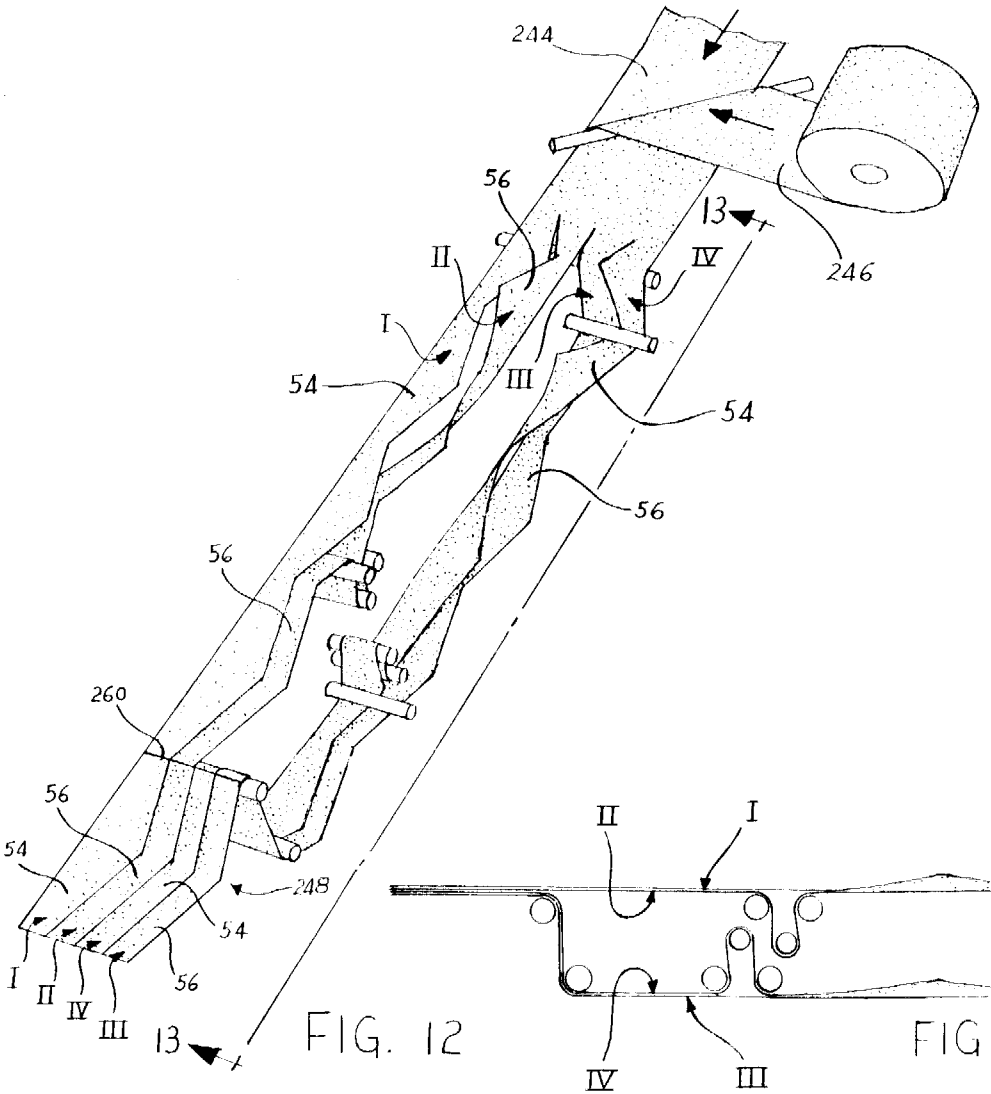
FIG. 12 is a schematic view of an alternative embodiment of the sleeve making section of the method shown in FIG. 1 illustrating the making of four continuous series-arranged pairs of sleeves.
Figure 13:
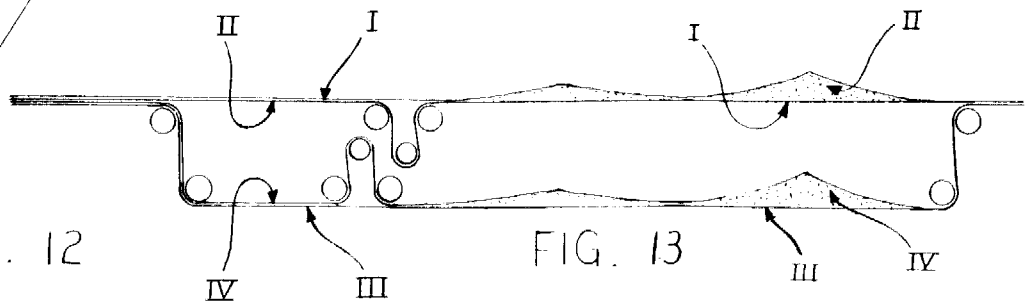
FIG. 13 is a vertical sectional view taken in the direction of lines 13—13 in FIG. 12.

In order to insure that the sleeve pairs reach a similar orientation, are in phase and are overlapped to form a set adapted to be severed and transferred from the sleeve line to the shingled arrangement, the second (II), third (III) and fourth (IV) series of sleeve pairs (counting from the left in FIG. 12) are guided by rollers and are either turned, or phased and turned, relative to the first series (I). Accordingly, the second series (II), as shown in FIG. 12, is turned and phased to bring the sleeve pairs 56 of that series into similar orientation and into phase with the sleeve pairs 54 of the first series (I). The third series (III) are phased only and the fourth series (IV) are turned and phased to bring the sleeve pairs 54, 56 into similar orientation; it will be noted that in utilizing the turning and phasing arrangement shown in FIG. 12, the sleeve pairs of the third series (III) as severed from the superposed webs, end up as the forwardmost and bottom sleeve pairs in the set 248 while sleeve pairs 54 of the the fourth series (IV) as severed from the superposed webs end up as the penultimate pair 54 above and adjacent the bottom sleeve pair.

After transversely severing the set 248 of four sleeve pairs along the severance line 260, the sleeve pairs can be transferred to parallel shingled arrangement for application of elastic.

Figure 14:
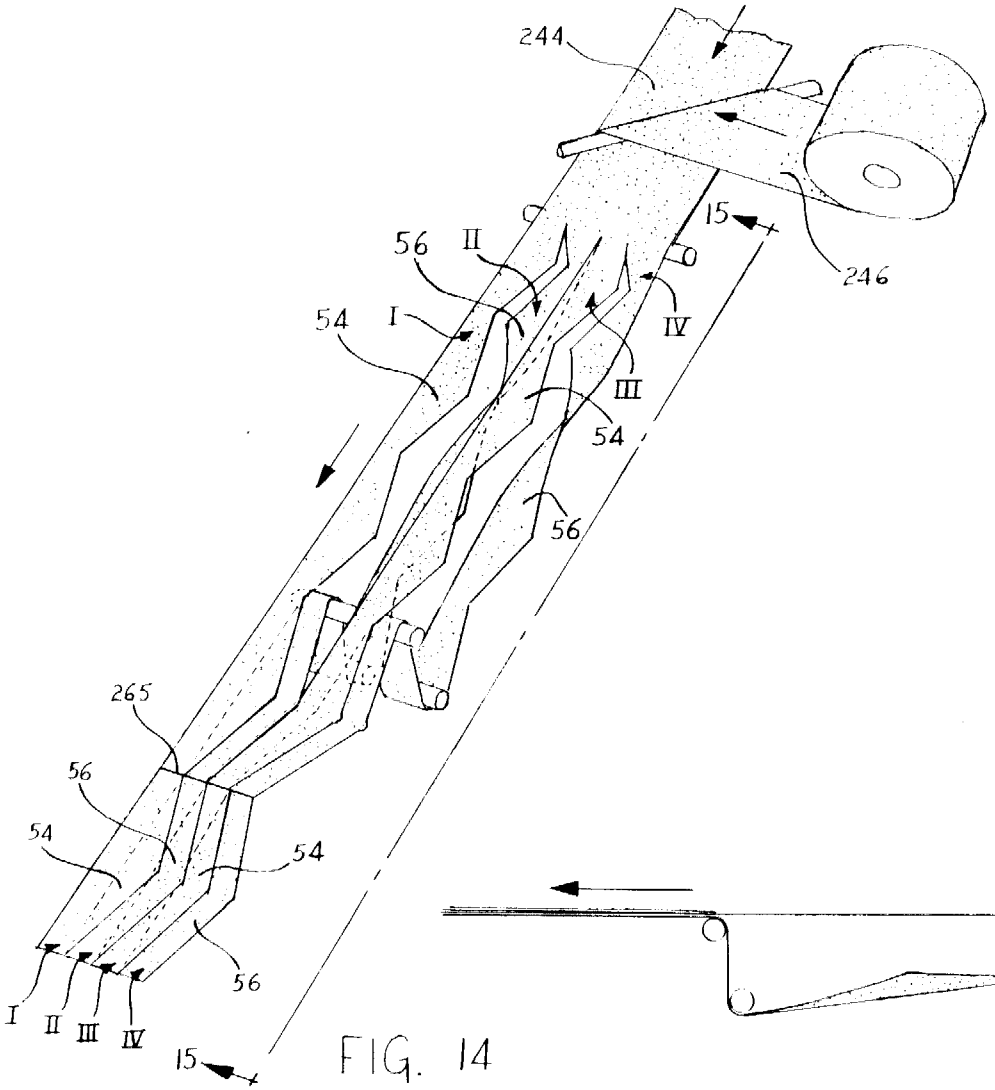
FIG. 14 is a schematic view of another alternative embodiment of the sleeve making section of the method shown in FIG. 1 illustrating alternative turning and phasing procedures utilized in making four continuous series-arranged pairs of sleeves.
Figure 15:
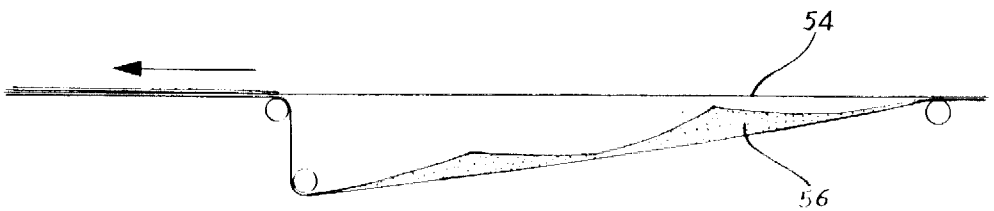
FIG. 15 is a vertical sectional view taken in the direction of lines 15—15 in FIG. 14.

Now referring to FIGS. 14 and 15, these Figures show another method for turning and phasing the sleeve pairs so that they reach a similar orientation and are in phase. In this method, the second and fourth series (II and IV) are turned and phased in the same fashion while the first and third series (I and III) are not turned but are retained in the same orientation until they reach the end of the sleeve line. By phasing the second and fourth series of sleeve pairs 56 as shown, they are brought into phase with the sleeve pairs of the first and third series which are similarly oriented and in phase as severed from the superposed webs 244, 246.

The overlapped sleeve pairs are severed along a severance line 265 to provide a set of four sleeve pairs for transfer to the shingled arrangement.

Sleeves can be made in multiple series with adjacent pairs oppositely oriented, for example, as in FIG. 9, or with all pairs reversely oriented, as in FIG. 11, by varying the longitudinal severing, guiding and phasing in the sleeve line.

METHOD OF FIGS. 16–17

Figure 17:
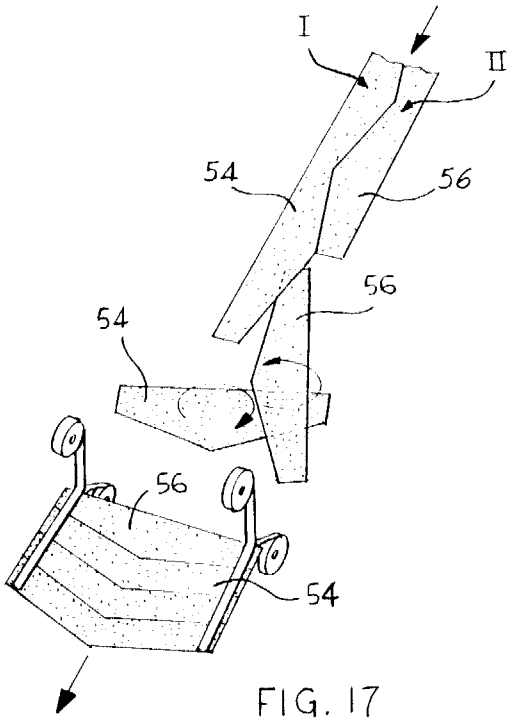
FIG. 17 is a schematic view of an alternative embodiment of the sleeve making section of the method shown in FIG. 1 illustrating the orientation of the sleeve line substantially in the same direction as the axis of the sleeves in the shingled arrangement, and the method of transferring the sleeves from series to parallel shingled arrangement for elastic application.
Figure 16:
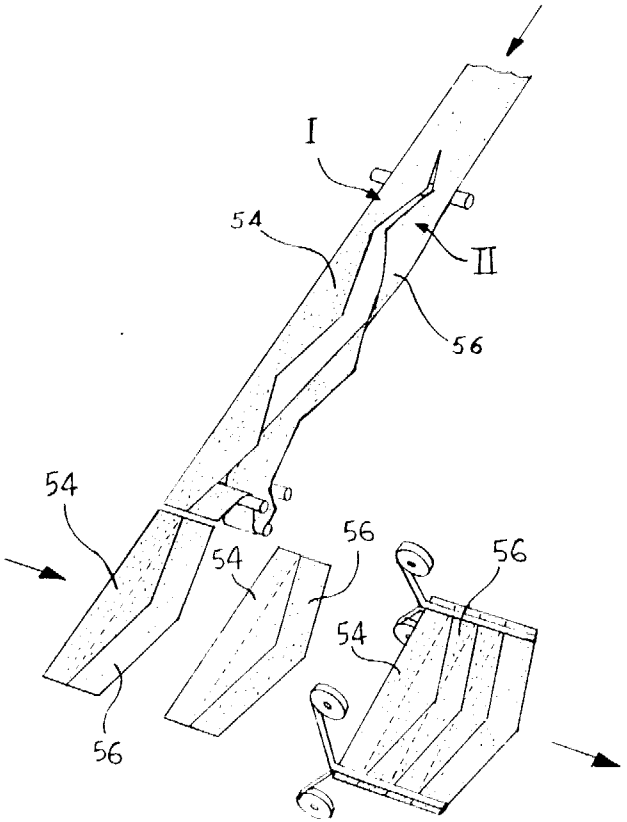
FIG. 16 is a schematic view on an enlarged scale of the sleeve making section of the method shown in FIG. 1.

While in FIGS. 4, 5 and 9 the sleeve line is oriented at a right angle to the axis of the shingled arrangement of the sleeve pairs, that orientation can be varied as machinery and plant lay-out considerations dictate. For example, the sleeve line may be located at a right angle to the axis of the shingled arrangement, as shown in FIG. 16, or may be arranged in the same direction, as shown in FIG. 17. When arranged in the same direction as shown in FIG. 17, sleeve pairs of all series are required to be turned 90 degrees for proper alignment with the axis of the shingled arrangement. The sleeve pairs 54 of the first series (I), as shown in FIG. 17, are turned in a clockwise direction 90 degrees while maintained substantially in their own plane, while the sleeve pairs 56 of the second series (II) are turned in counterclockwise direction 90 degrees, also while being maintained substantially in their own plane. Substantially with their clockwise or counterclockwise movement, the sleeve pairs are also transferred laterally to positions between the elastic bands in the shingled arrangement so that the elastic may be attached to the cuff of the sleeves by adhesive or other similar means.

In carrying out this invention, the cuff elastic is unwound from rolls while maintained under tension and applied to the cuffs. The elastic bands are attached to both the top and bottom surfaces of the cuffs, where it is desired to provide a substantially continuous band around the cuff and thereby achieve a uniformly gathered cuff. It is possible, however, to apply elastic to one side only of the cuff to achieve an elasticized cuff suited for some end uses.

METHOD OF FIGS. 18–20

Figures 18, 19, 20:
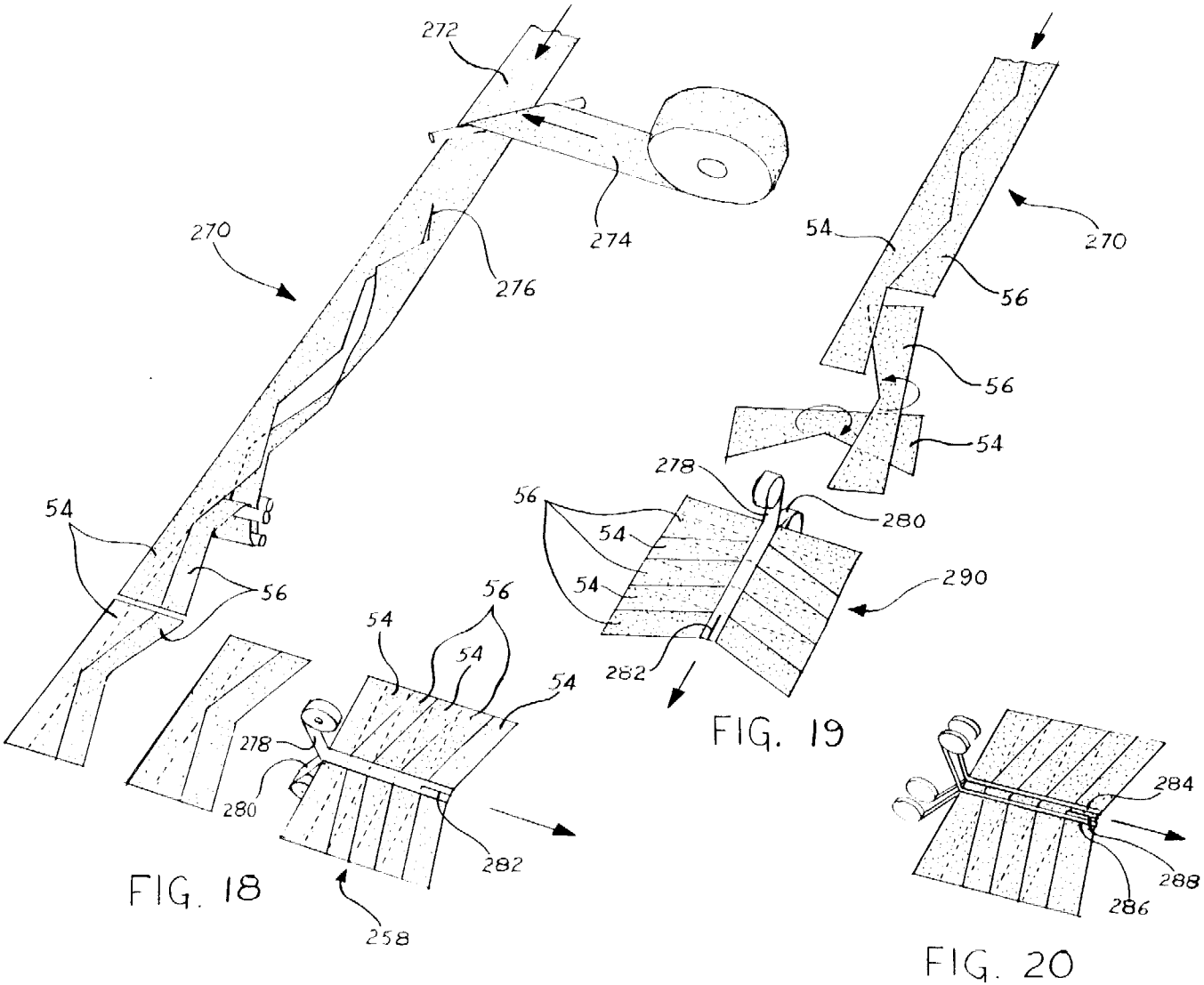
FIG. 18 is a schematic view of an alternative embodiment of a sleeve making section illustrating sleeve making and transferring to a shingled arrangement as shown in FIG. 11.
FIG. 19 is a schematic view of a sleeve making section in which the sleeve line is in the same direction as the axis of the shingled arrangement in which sleeves in pairs are associated cuff to cuff and showing attaching elastic to the cuffs.
FIG. 20 is a fragmentary schematic view showing attachment of separate bands of elastic to the cuffs of sleeves in a shingled arrangement in which the sleeve pairs have an orientation similar to FIGS. 18 and 19.

In carrying out the invention, as shown in FIG. 11 elastic may be attached to the cuffs of sleeves associated in pairs cuff to cuff and then transferred as individual sleeves to the first moving web 200. To illustrate how sleeves are made in pairs associated cuff to cuff and transferred to a shingled arrangement so as to have the reverse orientation shown in FIG. 11, reference is made to FIG. 18 in which a sleeve line 270 is arranged perpendicularly to the axis of a shingled arrangement 258 of sleeve pairs which have been transferred from a sleeve line 270. The method illustrated in FIG. 18 involves providing longitudinally moving continuous superposed webs 272, 274 of sleeve material unwound from rolls and attaching and severing the moving webs by forming seams and severing along longitudinal lines 276 defining two continuous series-arranged flattened pairs 54, 56 of left and right sleeves. Pairs of sleeves are then severed by cutting the continuous webs transversely where the shoulders join to provide sleeve pairs 54, 56 associated cuff to cuff for transfer to the shingled arrangement 258. Single wide bands 278, 280 of elastic are attached to each of the top and bottom surfaces of the cuffs in the shingled arrangement 258 and the elastic and the cuff material is simultaneously cut along a severance line 282 to divide the sleeve pairs into individual sleeves with cuff elastic. Alternatively, a pair of narrow bands 284, 286 of elastic can be attached to each of the top and bottom surfaces of the cuffs, as shown in FIG. 20, in which case the cuff material is cut between the elastic bands along a severance line 288 to divide the sleeve pairs.

It is feasible to vary the method by arranging the sleeve line at any desired direction relative to the axis of the shingled arrangement. Thus, instead of being perpendicularly oriented, the sleeve line 270 can be arranged at any angle and is shown in the same direction as the shingled arrangement 290 in FIG. 19. In an arrangement such as shown in FIG. 19, the sleeve pairs 54, 56 are turned up to 90 degrees (depending on the specific angle) to align them with the other sleeve pairs in the shingled arrangement 290. In the illustration of the invention shown in FIG. 19, single wide bands 278, 280 of elastic are attached to each of the bottom and top surface of the cuffs, as in FIG. 18, and the cuff elastic and cuff material are severed simultaneously along a severance line 282 to divide the sleeve pairs.

OTHER VARIATIONS IN THE METHOD

As previously indicated, various alternative or optional steps can be utilized in methods according to this invention to change the form of the garments produced. Thus, instead of a back opening type gown, the method of this invention may be used to manufacture a front opening gown, jacket or coat. For this purpose, the location of the neck openings can be changed to suit the type of garment being made. Other types of sleeves may be made, such as short or three-quarter length, with or without attached elastic bands. Other garment fashioning steps may be included, for example, shaping the garment body panels by cutting the panel webs or shaping the sleeves.

Variations may be introduced in the method to change the seams of the garments by varying the procedures for folding the marginal edges of the body panel webs before they are attached; for example, marginal portions of one or the other, or both the front and back panel webs may be inwardly folded before attachment to provide the desired seam configuration.

Other types of textiles or textile-like garment materials can be used besides the material specifically disclosed as preferred for the garments made with the method of this invention. The term "garments" is used in a broad sense to refer to articles made from textile material. The method is applicable to the attachment of components of various kinds to continuous, moving webs including the sleeves, belts and closure tabs specifically referred hereinbefore. Thus, the method of this invention is applicable to the manufacture of articles by combining components of the articles with continuous, moving webs to produce finished articles in a continuous manner, in series.

In connection with the use of the method for manufacturing sleeves of garments with elasticized cuffs, the previous description has mentioned that it is preferred to maintain the elastic under tension while it is attached to the cuffs by adhesive. It will be understood that different types of elastic and attachment methods may be used. Natural or synthetic rubber or rubber-like materials may be used for the elastic bands. Alternatively, elastic may be used of the well known type that is relaxed when attached and subsequently activated by heat or other means to shrink and obtain its elastic properties.

Alternative method steps may be utilized to increase the overall production rate or to improve the transfer rate between stages of the method in order to simplify the machinery required to implement the method. For machinery or plant lay-out reasons, the arrangement and relative orientation of the various stages of the method may be varied or changed; for example, the location of the sleeve line may be varied relative to the axis of the shingled arrangement from the manner illustrated; likewise, the shingled arrangement may be varied in its location and orientation relative to the garment line in which the sleeves are placed and combined with the body panel webs.

The foregoing and other alternatives and variations may be made within the spirit and scope of the invention as defined in the appended claims.

We claim:

1. A method for manufacturing garments from continuous webs comprising the steps of:

making flattened pairs of left and right sleeves arranged in series from longitudinally moving superposed webs of sleeve material;

transferring said flattened sleeve pairs from series to parallel shingled arrangement with cuffs sequentially aligned;

attaching elastic to aligned cuffs of said shingled sleeves;

transferring sleeves having cuff elastic from said shingled arrangement to longitudinally spaced positions on a first moving web of garment body material and attaching shoulder ends of said sleeves to said web;

combining said first web and attached sleeves with a second moving web of garment body material superposed and moving with said first moving web;

attaching said first and second moving webs and shoulder ends of said sleeves along longitudinal side seam lines at the margins of said webs and attaching said moving webs along transverse shoulder seam lines; and severing said moving webs including transverse cuts adjacent said shoulder seam lines to form garments.

2. A method according to claim 1 in which:

said sleeves are associated shoulder to shoulder in said pairs; and said first moving web is divided to provide substantially half-width sections adapted to form complementary halves of a garment body panel with sleeves attached thereto at their shoulder ends at spaced intervals; including the steps of:

guiding and phasing said half-width sections of said first moving web into parallel overlapping relationship with the sleeves in left and right hand position and the shoulder ends of the sleeves laterally aligned and located at the outer margins of the overlapped sections prior to combining with said second moving web.

3. A method according to claim 2 in which pairs of sleeves transferred from shingled arrangement are divided into individual sleeves simultaneously with dividing said first moving web.

4. A method according to claim 2 or 3 in which said guiding and phasing of said sections of said first moving web continues one section along a straight path and laterally displaces the other section to the opposite side of said one section into parallel overlapping relationship to arrange the sleeves in left and right hand position.

5. A method according to claim 1 in which one of said moving webs is divided into substantially half-width sections adapted to form complementary halves of a garment body panel and attached at their outer margins to the other moving web and the shoulder ends of the sleeves.

6. A method according to claims 1, 2, 3 or 5 in which marginal portions of one of said moving webs is infolded and attached along longitudinal side seam lines to the other moving web and shoulder ends of the sleeves to provide a lapped side seam.

7. A method according to claim 1 in which said sleeves are associated shoulder to shoulder in said pairs including the steps of:

continuously tucking said first moving web so as to bring marginal portions of the web together in the same plane;

attaching shoulder ends of each pair of associated sleeves to said marginal portions of said first moving web along longitudinal side seam lines while individual sleeves of said pairs are maintained in abutting relationship;

dividing said sleeve pairs; and flattening said first moving web and folding said sleeves against said first moving web with the sleeves arranged in left and right hand position.

8. A method according to claim 7 in which folding said sleeves provides shoulder ends infolded at the margins of said first moving web, said second moving web is longitudinally divided into substantially half-width sections adapted to form complementary halves of a garment body panel, and said sections are guided into overlapping relation and attached at their outer margins to said first moving web and said infolded shoulder ends of the sleeves.

9. A method according to claim 1 in which adjacent sleeve pairs in said shingled arrangement are oppositely oriented;

sets of two oppositely oriented sleeve pairs are transferred from said shingled arrangement and placed on said first moving web longitudinally spaced at intervals corresponding to the length of two garments; and after attaching said moving webs and said sleeves along said side seam lines and said shoulder seam lines, garments are formed connected head to head and said moving webs are severed transversely intermediate said positions of said sets, in addition to adjacent said shoulder seam lines, to separate and form the finished garments.

10. A method for manufacturing garments according to claim 1, 2, 3, 5, 7 or 8 in which said sleeves are transferred from shingled arrangement to longitudinally spaced positions on a first moving web while maintained associated in pairs abutting shoulder to shoulder or cuff to cuff.

11. A method for the manufacture of garments according to claim 1 in which said sleeve pairs are divided and individual sleeves are transferred from shingled arrangement to longitudinally spaced positions on a first moving web.

12. A method for the manufacture of garment sleeves from continuous webs comprising the steps of:

providing longitudinally moving continuous superposed webs of sleeve material;

attaching and severing said moving webs along longitudinal lines defining continuous series-arranged flattened pairs of left and right sleeves;

severing flattened sleeve pairs from said series arrangement associated cuff-to-cuff or shoulder to shoulder;

transferring each severed flattened sleeve pair from series to parallel shingled arrangement with cuffs sequentially aligned; and applying elastic to said cuffs while sequentially aligned.

13. A method for manufacturing garment sleeves according to claim 12 including the step of turning and phasing certain of said series arranged sleeve pairs relative to other of said series arranged sleeve pairs to align said sleeve pairs in phase and similar orientation while continuing in series arrangement and prior to severing and transferring to said shingled arrangement.

14. A method for manufacturing garment sleeves according to claim 12 in which said longitudinal lines define an even number of continuous series-arranged flattened pairs of left and right sleeves.

15. A method for manufacturing garment sleeves according to claim 12, 13 or 14 in which said continuous superposed webs move longitudinally in a direction transverse to the axis of alignment of said sleeve pairs in said shingled arrangement.

16. A method for manufacturing garment sleeves according to claim 12, 13 or 14 in which said continuous superposed webs move longitudinally in a direction parallel to the axis of alignment of said shingled arrangement, and each set of severed, sleeve pairs is turned ninety degrees to align with said axis.

17. A method according to claim 12 in which certain of sleeve pairs are turned and phased relative to other sleeve pairs to align them in a similar orientation for transfer to said shingled arrangement.

18. A method according to claim 12 in which certain of sleeve pairs are turned and phased relative to other sleeve pairs to align them in phase and opposite orientation for transfer to said shingled arrangement.

19. A method according to claim 12 in which said elastic is in a stretched condition when applied to said cuffs.

20. A method according to claim 12 in which said elastic is in a relaxed condition when applied to said cuffs.

21. A method for manufacturing garments from continuous webs comprising the steps of:

providing flattened left and right sleeves associated in pairs abutting shoulder to shoulder;

providing a longitudinally moving first continuous garment body web;

transferring said sleeve pairs while individual sleeves of said pairs are maintained in abutting relationship and placing said sleeve pairs on said first moving web so as to be laterally centered and longitudinally spaced at intervals determined by the length of the garments;

dividing said sleeve pairs and guiding individual sleeves and said first moving web relatively to position the shoulder ends of said sleeves at the margins of said first moving web and the sleeves in left and right hand position extending inwardly toward the center thereof;

providing a second continuous garment body web superposed and moving with said first moving web;

attaching (1) said first and second moving webs and (2) said first and second moving webs and the shoulder ends of said sleeves, along longitudinal side seam lines at the margins of said webs and (3) said first and second moving webs along transverse shoulder seam lines extending next to said sleeves, said shoulder seam lines being interrupted to provide neck openings; and severing said first and second moving webs including a transverse cut adjacent said shoulder seam lines to form garments.

22. A method according to claim 21 in which said first moving web is divided into substantially half-width webs adapted to form complementary halves of a garment body panel.

23. A method for manufacturing garments from continuous webs comprising the steps of:

making flattened left and right sleeves associated in pairs from longitudinally moving superposed webs of sleeve material;

transferring each flattened sleeve pair to parallel shingled arrangement;

providing a longitudinally moving first continuous garment body web;

transferring said sleeve pairs from said shingled arrangement to positions flat on said first moving web and longitudinally spaced at intervals determined by the length of the garments;

combining said first web and attached sleeves with a second continuous garment body web superposed and moving with said first moving web;

attaching said moving webs and shoulder ends of said sleeves along longitudinal side seam lines at the margins of said webs, and attaching said moving webs along transverse shoulder seam lines; and severing said moving webs including cuts adjacent said shoulder seam lines to form garments.

24. A method for manufacturing garments from continuous webs comprising the steps of:

providing flattened left and right sleeves associated in pairs abutting shoulder to shoulder;

transferring said sleeve pairs while individual sleeves of said pairs are maintained in abutting relationship and placing said sleeve pairs on a first moving web so as to be laterally centered and longitudinally spaced at intervals determined by the length of the garments;

attaching a shoulder end of each sleeve to said first moving web along longitudinal seam lines;

dividing the sleeve pairs to form individual sleeves attached at said intervals to said first moving web;

providing a second continuous garment body web superposed and moving with said first moving web;

attaching (1) said first and second moving webs and (2) said second moving web and the shoulder ends of said sleeves along longitudinal side seam lines at the margins of said webs;

attaching said first and second moving webs along transverse shoulder seam lines extending next to said sleeves, said shoulder seam lines being interrupted to provide neck openings; and severing said first and second moving webs including a transverse cut adjacent said shoulder seam lines to form garments.

25. A method for manufacturing garments from continuous webs comprising the steps of:

making flattened pairs of left and right sleeves arranged in series from longitudinally moving superposed webs of sleeve material;

transferring left and right sleeves of successive pairs continuously from said series arrangement to parallel longitudinally spaced positions on a first moving web of garment body material and attaching shoulder ends of said sleeves to said web;

combining said first web and attached sleeves with a second moving web of garment body material superposed and moving with said first moving web;

attaching said first and second moving webs and shoulder ends of said sleeves along longitudinal side seams lines at the margins of said webs and attaching said moving webs along transverse shoulder seam lines; and severing said moving webs including transverse cuts adjacent said shoulder seam lines to form garments.

* * * * *